United States Patent [19]

Lyman

[11] Patent Number: 4,523,965

[45] Date of Patent: Jun. 18, 1985

[54] HIGH CARBON STEEL MICROCRACKING CONTROL DURING HARDENING

[75] Inventor: John R. Lyman, Orono, Me.

[73] Assignee: Board of Trustees of the University of Maine, Bangor, Me.

[21] Appl. No.: 472,656

[22] Filed: Mar. 7, 1983

[51] Int. Cl.[3] ..... C21D 1/18

[52] U.S. Cl. ..... 148/143; 148/36

[58] Field of Search ..... 148/143, 144, 36

[56] References Cited

U.S. PATENT DOCUMENTS 3,337,376 8/1967 Grange ..... 148/143

*Primary Examiner*—R. Dean

*Attorney, Agent, or Firm*—Daniel H. Kane, Jr.

[57] ABSTRACT

A method for hardening high carbon steel is described for achieving fully austenitized martensite steel without microcracking. Steel is heated to the full austenitizing temperature of the selected steel composition for fully dissolving the carbon phase. The austenitized steel is quenched in an intermediate quenching step to a temperature below the martenite start temperature for the selected steel composition to initiate transformation of only a minor portion of the austenite structure to martensite. The martensite so formed is tempered in an intermediate tempering step to a temperature above the intermediate quench temperature for imparting toughness to the minor portion of martensite formed in the intermediate quenching step. In a final quenching step the remaining austenite is transformed to martensite so that the steel as finally quenched comprises a major portion of untempered martensite generally of smaller crystal size intermixed with a minor portion of tough tempered martensite of larger crystal size. In a final tempering step the martensite can be transformed to a finely dispersed mixture of carbide precipitate in ferrite without microcracks and with a carbon content that would ordinarily cause microcracking according to conventional hardening methods.

18 Claims, 2 Drawing Figures

HIGH CARBON STEEL MICROCRACKING CONTROL DURING HARDENING

TECHNICAL FIELD

This invention relates to a new method for hardening high carbon steel and in particular for hardening fully austenitized martensite steel. The invention controls and essentially eliminates microcracking in the martensitic structure of the high carbon steel as quenched.

BACKGROUND ART

According to a conventional method for preparing and hardening carbon steels, a ferrite and carbide mixture containing carbon in the desired percentage by weight is heated to the "austenitizing" temperature range. As used herein high carbon steel refers to steel having a carbon content of 0.6% by weight or greater. In the starting ferrite, iron atoms assume a cubic crystal structure with an additional iron atom at the center of the cube. The ferrite crystal structure is referred to as a body centered cubic structure and can dissolve and retain only 0.025% by weight carbon at temperatures up to 1341° F. (727° C.). In order to obtain high carbon steels of greater hardness and strength having a dissolved carbon content greater than, for example, 0.6% by weight carbon, the ferrite is heated to the austenitizing temperature range at which the crystal structure transforms from a body centered cubic form to a face centered cubic form having an additional iron atom at the center of each face of the cube. This new transitional crystal structure of iron or steel is referred to as austenite and is capable of dissolving up to a limit of, for example, 2.1% carbon at an austenitizing temperature of, for example, 2000° F. (1093° C.). The fully austenitizing temperature range for typical low alloy steel compositions is, for example, 1500° F. (815° C.) to 2000° F. (1093° C.).

After the desired carbon content has been diffused and dissolved in the austenite, the austenite is rapidly quenched or cooled to a low temperature such as room temperature or lower. During the final stages of the rapid quenching and beginning at the martensite start temperature, the austenite transforms to martensite in which the carbon is retained in solution in the crystal structure. The martensite is a body centered tetragonal structure in which the carbon is retained without precipitation. It may be viewed as ferrite supersaturated with carbon. For typical low alloy steel compositions the austenite begins to transform into martensite in the range of, for example, 280° F. (138° C.) to 310° F. (155° C.) and in some instances as high as 400° F. (205° C.). The transformation of austenite to martensite is dependent on both the rate of change of temperature and the temperature. Upon quenching to room temperature or with cold treatment to even lower temperatures, most of the austenite is transformed to martensite. Martensite exhibits severe distortion and stress of the crystal lattice as a result of the carbon incorporated by solution in the martensite structure.

According to the conventional method for preparing and hardening martensite steel, the martensite is then subject to a final tempering step in which the martensite is heated to a temperature in the range, for example, 400° F. (210° C.) to 1100° F. (600° C.). During the final tempering, the martensite decomposes into a carbide precipitate such as cementite in a ferrite matrix. The tempered martensite therefore comprises two phases of ferrite and carbide or cementite in a fully dispersed mixture. The decomposition of martensite into cementite and ferrite is dependent upon temperature and is also dependent upon the time at the tempering temperature.

The martensite in the "as quenched" state prior to tempering exhibits increasing hardness with increase in carbon content and accompanying lattice stress. The highly stressed martensite exhibits undesirable brittleness. Upon tempering, there is some loss of hardness but greater toughness of the steel as the highly stressed martensite relaxes to ferrite and carbide. The lower the tempering temperature, the finer the structure and finer the particles of cementite imbedded in the ferrite matrix. A coarser structure is exhibited by higher tempering temperatures.

A number of disadvantages are encountered in forming and hardening high carbon martensite steels having a carbon content of 0.6% by weight or greater according to the conventional method. As the carbon content of the martensite increases, the crystalline form changes. At carbon contents above 0.6% by weight the crystals form plate or disc microstructures which are prone to crack. Such cracks, which are confined to single crystals of martensite are defined and referred to herein as microcracks. Microcracking is believed to result from impingement of growing martensite crystals against one another during the martensite transformation. In the untempered, as quenched condition, the martensite transformation produces regions of high stress where plates impinge upon one another. These stresses are relieved by microcracking. Thus, some of the lattice stresses in the martensite are relieved by microcracking during quenching. While subsequent tempering relaxes or relieves the stress in the remaining martensite structure, microcracks formed during the martensite transformation remain in the tempered structures.

Thus, in the ideal method the desired carbon content is incorporated in the steel by completely diffusing and dissolving the carbon at the full austenitizing temperature followed by substantially complete transformation of the austenite to martensite in a rapid quench to room temperature or with cold treatment to lower temperature. The rapid quench or a marquench effectively retains the carbon in solution in the martensite structure viewed as ferrite supersaturated with carbon. The purpose of the martensite transformation prior to tempering is to provide greatest homogeneity of carbon distributed in iron or steel. The martensite further provides the greatest dispersion of carbon in the iron or steel structure upon tempering. Upon tempering, fine grains or particles of carbides such as cementite precipitate while the martensite relaxes to ferrite providing carbon steel with greatest homogeneity and mixture of the two phases. The technological difficulty that is encountered in applying the otherwise ideal conventional method of martensite hardening to high carbon content steel is of course the occurrence of microcracking. The solution to the problem of microcracking in high carbon martensite has proved intractable. Two approaches have developed for minimizing or reducing microcracking.

According to a first method, the amount of carbide dissolved in austenite to provide carbon in solution in the austenite structure is limited by controlling the austenitizing temperature and the time at austenitization. The austenite is then rapidly quenched without complete solution of the full carbon content of the steel. The austenite and transformed martensite contain undissolved or residual carbides so that the carbon content in solution in the martensite is relatively low, below, for example, 0.6% by weight carbon. As a result the low carbon content martensite formed during quenching and transformation of austenite to martensite is not subject to microcracking. In other words, high carbon content by weight is incorporated in the steel partly in the form of undissolved or residual carbides with a relatively low percentage of carbon dissolved in the martensite. However, the fracture toughness of steels with undissolved carbides in the microstructure is inferior. Fatigue resistance of high carbon steels with residual carbides in the martensitic microstructure is also lower. A description of this prior art method which seeks to achieve finer dispersion of undissolved carbide in the final structure is found, for example, in U.S. Pat. No. 3,575,737.

This conventional approach is further exemplified in the Grange U.S. Pat. Nos. 3,337,376 and 3,891,474 which also seek to achieve very finely dispersed undissolved carbide in a matrix of low carbon content martensite in the "as quenched" state. The final tempered steel achieved by Grange is therefore only a partial percentage of tempered martensite mixed with a separate phase of dispersed carbides. As a result, Grange cannot achieve a truly homogeneous dispersion of carbide in ferrite after final tempering. Only a portion of the steel with relatively low carbon content is austenitized and quenched to martensite while the remaining portion is composed of an undissolved and dispersed carbide phase.

Moreover, the Grange U.S. Pat. No. 3,891,474 deals only with the carburizing of low carbon steel having a content of less than 0.4% by weight carbon. While the Grange U.S. Pat. No. 3,337,376 describes methods for hardening steel which contain 0.8% or more of carbon, the steel always comprises an undissolved carbide phase and is never subjected to a complete martensite transformation.

In summary, by this first conventional approach to reduce microcracking, the steel ends up with low carbon content in the austenitic phase, for example, less than 0.6% by weight carbon. Ordinary engineering low alloy high carbon steel conventionally includes part of the carbon in a separate carbide or cementite phase to avoid microcracking. Only a portion of the high carbon content is actually incorporated by solution in the austenite and martensite to avoid the microcracking which occurs in the martensite crystals with high carbon content in solution.

According to a second conventional method to control and reduce microcracking, the austenite grains achieved during austenitization to dissolve the carbides are limited in size. Limitation of the austenite grain size in turn limits the size of the corresponding martensite grains after quenching and martensite transformation. In order to achieve rapid austenitization to limit the time and therefore crystal growth or grain size in the austenite temperature range, the steel must be specially prepared, for example, by preheat treatment to have a homogeneous bainite or pearlite microstructure so that solution of a finally dispersed carbide phase can occur rapidly at austenitizing temperature. Rapid heating to the critical austenite temperature range must be followed by rapid quenching as soon as the carbide phase is dissolved in the austenite since rapid austenite grain growth occurs in this temperature range. For example, it may be necessary to heat at rate of 300° F. per second and to hold the critical temperature for no more than 20 seconds. Thus, elaborate temperature control is required and even with this control microcracking still is present in the "as quenched" untempered martensite. This is true even when the martensite is transformed from austenite grain sizes as fine as ASTM No. 9. Moreover, the carbide phase is seldom completely dissolved because of the time limits imposed leaving an undissolved carbide phase. This more elaborate and more costly process is not conductive to widespread commercial application. A prior reference exemplifying this method of rapid heating and short holding time for controlling the grain size of the austenite is found in U.S. Pat. No. 3,271,206 for "Short Time Heat Treating Process for Steels".

An additional problem related to the occurrence of microcracks is that microcracks generally cannot be healed by further heat treatment, tempering or anealing. With increased temperature over 1000° F. (538° C.) there is some healing of microcracks but a large portion of residual microcracking remains.

Thus, the steelmaker is limited to a low carbon austenite and martensite, for example, as described in U.S. Pat. Nos. 4,067,756, 3,920,490, and 3,891,474; to the use of a high alloy steel for increased toughness and strength, for example, as set forth in U.S. Pat. Nos. 3,575,737 and 3,619,302; or to maintaining a significant portion of the carbon in a separate dispersed but undissolved carbide phase, for example, as set forth in U.S. Pat. Nos. 3,337,376 and 3,271,206.

To applicant's knowledge, no one has yet been able to achieve an ordinary engineering low alloy steel in the form of a high carbon martensite with essentially complete austenitization and transformation to martensite without significant microcracking.

OBJECTS OF THE INVENTION

It is therefore an object of the present invention to provide a new and improved method for preparing and hardening low alloy high carbon martensite steel essentially free of microcracks.

Another object of the invention is to provide a method for hardening high carbon steel with essentially complete solution of the carbide phase and carbon during austenitization and substantially complete transformation of austenite to martensite, with the high carbon content retained in solution in the martensite structure and all without substantial microcracking.

A further object of the invention is to provide a microcrack-free high carbon martensite steel formed without an undissolved carbide phase and with essentially complete solution of the carbon in the martensite "as quenched".

Thus, the invention seeks to achieve a method for forming and hardening low alloy high carbon martensite steels at a carbon content in the martensite above the level which causes microcracking according to conventional procedures and yet which is essentially all martensite rather than a mixture of martensite with an undissolved carbide phase. The invention also seeks to provide an inexpensive method adaptable for wide commercial application.

DISCLOSURE OF THE INVENTION

In order to accomplish these results the present invention provides a method for hardening high carbon steel applicable to a variety of low alloy steel compositions by heating the steel to the full austenitizing temperature of the selected steel composition and maintaining the full austenitizing temperature for sufficient time to dissolve the high carbon content phase into the austenite structure. Thus, the carbide phase is completely incorporated into the austenite structure with high carbon content in the range of greater than, for example, 0.6% by weight carbon fully dissolved. The invention then provides a novel intermediate quenching step by rapidly quenching the austenitized steel to a temperature below the martensite start temperature for the selected steel composition but substantially above the final quench temperature. Preferably, the intermediate quenching temperature is just below and maintained as closely as possible to the martensite start temperature. The time duration of the intermediate quenching is controlled and limited to initiate transformation of only a minor portion of the austenite structure to martensite. For example, 20% to 30% of the austenite is transformed to martensite by the intermediate quenching step.

According to the invention, the intermediate quenching step is followed by a further novel intermediate tempering step or upquenching step to a temperature above the intermediate quench temperature for tempering the minor portion of martensite transformed in the intermediate quenching step. Preferably, the intermediate tempering is carried out at a temperature in the lower end of the martensite tempering temperature range, for example, 500° F. (260° C.). The intermediate tempering or upquenching temperature is maintained for a sufficient time duration to temper and impart toughness to the minor portion of martensite previously formed.

The invention also contemplates a final quenching step by quenching the steel from the intermediate tempering temperature to a final quenching temperature substantially below the intermediate quenching temperature, for example, room temperature. The final quench transforms substantially all of the remaining austenite to martensite. The martensite is then tempered in a final tempering step yielding a microcrack-free martensite steel in the form of finely dispersed precipitated carbide in ferrite with the greatest achievable homogeneity.

A feature and advantage of the novel intermediate quenching step is that large martensite crystals grow during the intermediate quenching phase at a temperature just below the martensite start temperature. Thus, martensite crystals nucleate in a minor portion of the austenite at the martensite start temperature and grow during the continuing reduction in temperature below the martensite start temperature. This transformation of a minor portion of the austenite to martensite and martensite crystal growth is then halted by the novel intermediate tempering step. The brief intermediate tempering, for example, carried out at 500° F. (260° C.) for a period of, for example 15 minutes, serves to temper and toughen the large intermediate martensite crystals distributed through the austenite structure. Thus, the lattice stress in the intermediate martensite crystals is relaxed through tempering and the tempered crystals are no longer subject to microcracking.

During the final quenching step substantially the remaining austenite is transformed to martensite and the final martensite crystal growth is separated by the large toughened and tempered crystals distributed throughout the steel microstructure. Another feature and advantage of the invention is that during the final cooling and transformation of the austenite to martensite, the martensite is formed in smaller crystals which are less prone to crack in any event. More importantly, the final martensite crystals are separated or segregated by the large and toughened intermediate martensite crystals and microcracking is not occasioned by the impingement of the final untempered martensite crystals against the tempered crystals distributed through the steel microstructure.

According to the present invention, the martensite as finally quenched comprises a mixture of a minor portion of slightly tempered martensite distributed and dispersed in a matrix of untempered martensite. Furthermore, the entire structure is essentially free from microcracks. While there may be some retained austenite in the steel after final quenching, most of the austenite has transformed to martensite and further transformation may be completed by cold treatment below room temperature to, for example, −107° F. (−77° C.).

The invention also contemplates a number of variations in the method. For example, the intermediate quenching phase may itself be accomplished in two steps, first a rapid quench to a temperature just above the martensite start temperature with slower cooling to a temperature below the martensite start temperature to grow the larger intermediate martensite crystals during the intermediate quenching step. After intermediate tempering, the final quench to room temperature or lower is carried out rapidly to form smaller martensite crystals in the final transformation of austenite to martensite. The martensite as quenched in the final quench thus comprises a mixture of a minor portion of larger tempered crystals distributed and separating a major portion of smaller martensite crystals. Typically, the percent of austenite transformed to martensite in the larger crystals during intermediate quenching is in the range of, for example, approximately 20% to 30% for low alloy high carbon steel such as the 52100. However, the percentage transformed in the intermediate quench which successfully avoids microcracking in the final quenching may vary with the particular steel.

The invention is applicable to a variety of low alloy high carbon steels of varying composition. Thus, the steel may have a carbon content in the range from 0.6% by weight carbon to up to approximately 1.5% by weight carbon.

Furthermore, there may be a variety of alloying metals together comprising low alloy content, for example, less than 5% by weight of the steel. The invention is of course applicable to pure ferrite and carbide steels without alloy content. For each selected composition of the low alloy high carbon steel, the full austenitizing temperature and the martensite start temperature of course differ and must be ascertained in each instance.

It is preferable according to the invention to heat the steel composition to the threshhold of the full austenitizing temperature range and carry out the austenitization just above the $A_{cm}$ temperature at the lower end of the range to minimize the size of the crystal growth of the austenite. Thus, steps are taken according to the invention to minimize the size of the austenite crystals in the first instance. During the final quench this facilitates transformation of austenite to small martensite crystals less subject in any event to microcracking.

The martensite start temperature also varies for each steel composition to be ascertained in each instance. If the intermediate quenching or cooling is permitted to go too low in temperature, excessive intermediate martensite is formed and microcracking begins. On the other hand, if the intermediate quenching step permits too little cooling below the martensite start temperature, insufficient martensite for intermediate tempering is formed to provide adequate barriers between the crystals transformed in the final quench. Microcracking may therefore occur in the martensite formed after intermediate tempering.

Overall, however, for each high carbon steel of selected composition the invention contemplates full austenization and full solution of the high carbon content above the $A_{cm}$ austenitizing temperature followed by an intermediate quenching step to a temperature just below the martensite start temperature for a sufficient time to cool the part to the quench temperature. Intermediate tempering and toughening of the intermediate martensite crystals formed by partial transformation of a minor portion of the austenite is followed by a final quench substantially transforming the remainder of the austenite to martensite. The mixture of a minor portion of larger martensite crystals toughened by slight tempering, distributed in a matrix of untempered martensite crystals according to the invention affords an essentially microcrack-free martensite as quenched. Final tempering yields a martensite steel of finely dispersed carbide in ferrite with greater homogeneity of carbide than heretofore achieved for high carbon steels.

DESCRIPTION OF PREFERRED EXAMPLE EMBODIMENTS AND BEST MODE OF THE INVENTION

Figure 1:
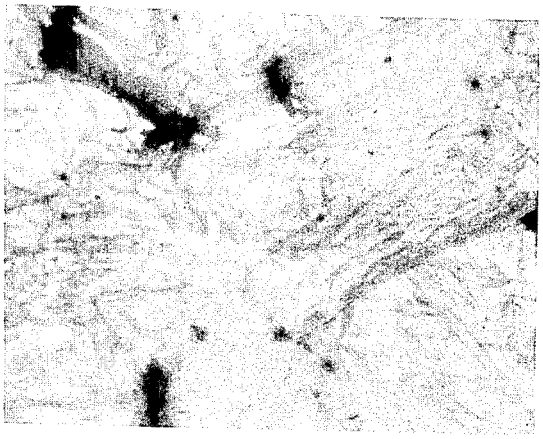
FIG. 1 is a metallographic etching (2% nital etch) at 1,000X magnification, of 52100 steel hardened according to conventional procedures by austenitizing at 1800° F. (982° C.) followed by rapid quenching to 100° F. (37° C.) illustrating the microcracking in the martensite crystal structures.

The following examples were carried out using AISI 52100 steel having the composition given in Table 1.

TABLE 1

| Composition of 52100 Steel by Weight Percent | | | | | | | | |
|---|---|---|---|---|---|---|---|---|
| C | Mn | P | S | Si | Cr | Ni | Mo | Cu |
| 0.96 | 0.33 | 0.005 | 0.007 | 0.24 | 1.48 | 0.27 | 0.04 | 0.08 |

For 52100 steel the martensite start temperature $M_s$ is between 280° F. (138° C.) and 310° F. (155° C.) for austenitizing temperatures between 1950° F. (1065° C.) and 1800° F. (982° C.). The minimum or threshhold temperature $A_{cm}$ to dissolve all carbides up to the maximum theoretical percent by weight in the austenite of 52100 steel is about 1800° F. (982° C.). The percent of martensite formed below the martensite start temperature $M_s$ is a function of the austenite temperature and the rate of cooling and is calculated with the formula set forth by Harris and Cohen in the article entitled, "Stabilization of the Austenite-Martensite Transformation" found in the transaction of the AIME, Vol. 80, 1949, Pages 447–470. In each of the following examples the test specimens of 52100 steel were 5/16 inch thick discs. Austenitizing was carried out in an electric muffle furnace with an air atmosphere. In Examples 1 and 2 the carbide was dissolved in austenite by austenitizing for approximately 40 minutes in the furnace maintained at 1950° F. (1065° C.).

EXAMPLE 1

After austenitization as set forth above the steel disc was quenched in an intermediate quenching step according to the invention in 325° F. (163° C.) uncirculated oil to a temperature just above the martensite start temperature followed by cooling in the oil to 260° F. (127° C.) in 34 minutes. The intermediate quenching step was followed by an intermediate tempering of the minor portion of martensite crystals formed in salt at 500° F. (260° C.) for 15 minutes. The sample was then subject to a final quenching to room temperature by air cooling.

EXAMPLE 2

The sample disc of 52100 steel was austenitized as set forth above, then quenched in an intermediate quenching step in 325° F. (163° C.) uncirculated oil followed by cooling in the oil to 220° F. (105° C.) in 57 minutes. The intermediate quenching step was followed by an intermediate tempering step in salt at 500° F. (260° C.) for 15 minutes. The sample was thereafter subject to final quenching by air cooling to room temperature.

The first and second examples significantly reduce microcracking in comparison to the conventional quench hardening. The procedure carried out in Example 1 essentially eliminated microcracking of the martensite formed during the intermediate quenching step. The final martensite formed by final quenching by air cooling from 500° F. (260° C.) exhibited only a small amount of microcracking. The procedure in Example 2 resulted in an occasional small microcrack in both the intermediate tempered martensite and in the final martensite formed during air cooling from 500° F. (260° C.). According to the examples, significant control of microcracking was effected by intermediate tempering at 500° F. (260° C.) for 15 minutes after intermediate quenching in the range from 220° F. (105° C.) to 260° F. (127° C.). It is theorized the minimization of microcracking consequent upon the novel intermediate tempering and quenching according to the invention is accomplished: (1) by avoiding excessive impingement of the intermediate martensite formed before intermediate tempering and; (2) by avoiding an excessive residual amount of martensite and therefore excessive impingement of untempered martensite to be formed in the final quench after intermediate tempering. As hereafter described, the method is further improved by minimizing the size of the austenite crystals or grains. Thus, for each steel composition there is an empirically determinable combination of intermediate quenching and intermediate tempering temperatures for minimizing microcrack size and frequency.

In Examples 3 through 7 set forth below the test specimens of 52100 steel were the same size discs as in Examples 1 and 2 but in each of the Examples 3 through 7 austenitization of the specimen was carried out at 1800° F. (982° C.) the threshold austenitizing temperature, for a period of one hour. The specimens were austenitized at the lower threshhold temperature to retard austenite crystal growth and grain size from that produced by austenitizing at 1950° F. (1065° C.).

EXAMPLE 3

The procedure described in Example 2 was carried after austenitizing the specimen at 1800° F. (982° C.) for one hour.

EXAMPLE 4

After austenitizing the specimen at the threshhold austenitizing temperature as set forth above, the 52100 steel disc was quenched in an intermediate quenching step in 220° F. (105° C.) uncirculated oil for 5 minutes. Thus, the specimen was directly quenched to a temperature below the martensite start temperature but substantially above the final quenching temperature. The intermediate quenching step was followed by an intermediate tempering in salt at 500° F. (260° C.) for 15 minutes. Final quenching was accomplished by air cooling to room temperature.

EXAMPLE 5

The procedure of Example 3 was repeated, except that the final quenching step concluded by cold treating the specimen in the range from −134° F. (−92° C.) to −103° F. (−75° C.) over a period of 65 minutes.

EXAMPLE 6

After austenitizing the specimen in the furnace at 1800° F. (982° C.) for one hour, the specimen was quenched in 212° F. (100° C.) boiling water for 5 minutes in an intermediate quenching step. The intermediate quenching step was followed by intermediate tempering in salt at 500° F. (260° C.) for 15 minutes. Final quenching was accomplished by air cooling to room temperature.

EXAMPLE 7

The procedures of Example 6 were repeated, however with the final quenching step concluding by cold treating the specimen at −108° F. (−78° C.) for one hour.

Figure 2:
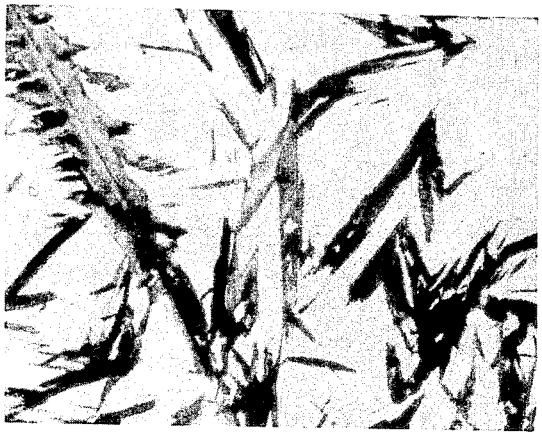
FIG. 2 is a metallographic etching (2% nital etch) at 1,000X magnification showing 52100 steel hardened according to the method of the present invention.

Examples 3 through 7 essentially avoided microcracking. An occasional microcrack could be found and could be identified as such by stains from leaching from the crack of the etchant on the metallographic sample surface. In each of the examples essentially eliminating microcracking, the specimen was fully austenitized with the carbide and carbon content fully dissolved in the austenite structure by austenitizing at the threshold austenitizing temperature which for 52100 steel is approximately 1800° F. (982° C.). Crystal growth and grain size were thereby minimized. A metallographic etching of a detailed fragment of the specimen resulting from the method of hardening according to the present invention set forth in Example 7 is illustrated in FIG. 2. No microcracks could be seen in this martensite following the novel intermediate quenching and tempering steps according to the present invention.

On the other hand, a metallographic etching of a specimen prepared according to the conventional hardening method is illustrated in FIG. 1. In this conventional control example the similar sized disc of 52100 steel was austenitized at 1800° F. (982° C.) for an hour. The specimen was then quenched in a conventional quenching process in 100° F. (38° C.) circulated oil. As illustrated in FIG. 1, the conventional method without intermediate quenching and tempering in accordance with the present invention caused severe microcracking. Similarly, autotempering with slow cooling from 325° F. (163° C.) to 250° F. (111° C.) in 36 minutes followed by air cooling to room temperature also caused severe microcracking in the sample.

Thus, the appropriate combination of: fully austenitizing the high carbon steel composition at the austenitizing threshhold temperature of the composition; intermediate quenching to a temperature below the martensite start temperature for the steel composition in a controlled, timed intermediate quench in the range below and adjacent to the martensite start temperature and substantially above the final quench temperature; and intermediate tempering to toughen the intermediate martensite crystals, essentially avoids microcracking in the final martensite "as quenched". The austenitizing threshhold temperature and martensite start temperature vary and are therefore selected for each high carbon steel composition. Generally, 20% to 35% and in the instance of 52100 steel, 25% to 35% of the engineering low alloy high carbon steel is transformed to martensite crystals during the intermediate quenching phase, although the optimum percentage will vary for different steels and is determined empirically in each instance. Furthermore, the austenite grain size during austenitization and therefore the martensite grain size from the quenching step is optimally minimized.

In addition to bulk hardening of high carbon steel the present invention is also applicable to surface hardening, carburizing, and case hardening methods and steps for surface hardness without microcracking. While the invention has been described with reference to particular example embodiments, it is apparent that it is intended to cover all modifications and equivalents within the scope of the following claims.

I claim:

1. A method for hardening high carbon steel comprising:

heating the steel to the full austenitizing temperature of the selected steel composition and maintaining the full austenitizing temperature for sufficient time to dissolve the high carbon content phase into the austenite structure;

quenching the austenitized steel in an intermediate quenching step to a temperature below the martensite start temperature for the selected steel composition but substantially above the final quench temperature and controlling and limiting the time duration of the intermediate quenching to initiate transformation of only a minor portion of the austenite structure to martensite;

tempering the martensite formed by the intermediate quenching step in an intermediate tempering step to a temperature above said intermediate quench temperature thereby halting the intermediate transformation to martensite and imparting toughness to the minor portion of martensite formed during the intermediate quenching step;

quenching the steel in a final quenching step to a final quenching temperature substantially below the intermediate quenching temperature and transforming the major portion of austenite to martensite so that the steel as finally quenched comprises a major portion of untempered martensite intermixed with a minor portion of tough tempered martensite thereby minimizing or avoiding microcracking which may by caused by mutual impingement of untempered martensite crystals.

2. The method of claim 1 further comprising the step of tempering the steel in a final tempering step thereby transforming the untempered martensite to a finely dispersed mixture of carbide precipitate in ferrite.

3. The method of claim 1 wherein the intermediate quenching step comprises quenching to a temperature below the martensite start temperature in a range immediately adjacent to the martensite start temperature.

4. The method of claim 3 wherein the intermediate quenching step further comprises controlling and limiting the time duration of the intermediate quenching to initiate transformation of only a minor portion of the austenite structure to martensite in the range of approximately 20% to 35% of the austenite.

5. The method of claim 4 wherein the intermediate quenching step comprises controlling and limiting the time duration of the intermediate quenching to initiate transformation of only approximately 25% of the austenite structure to martensite.

6. The method of claim 1 wherein the step of heating the steel to the full austenitizing temperature comprises heating to the threshhold austenitizing temperature of the selected steel composition and controlling and limiting the time period at the threshhold austenitizing temperature only to the time necessary to dissolve the desired high carbon content phase into the austenite thereby minimizing the austenite crystal size.

7. The method of claim 1 wherein the high carbon steel composition comprises 52100 steel and wherein the full austenitizing temperature is selected in the range of from approximately 1800° F. (982° C.) to 1950° F. (1065° C.); said intermediate quenching temperature is selected in the range of approximately from 212° F. (100° C.) to 280° F. (138° C.); said time duration of the intermediate quenching step is selected in the range of five minutes to one hour; wherein the intermediate tempering temperature is selected in the range of approximately from 400° F. (205° C.) to 500° F. (260° C.); and further comprising the step of limiting the intermediate tempering step to a time duration of approximately ten to thirty minutes.

8. The method of claim 7 wherein the final quenching temperature is room temperature.

9. The method of claim 7 wherein the final quenching step comprises cold treating the steel to a temperature substantially below room temperature.

10. The method of claim 7 wherein said full austenitizing temperature is selected to be approximately 1800° F. (982° C.); said intermediate quenching step temperature is selected to be approximately 220° F. (105° C.) to 260° F. (127° C.); said intermediate tempering temperature is approximately 500° F. (260° C.); the duration of the intermediate tempering step is approximately fifteen minutes; and wherein the steel is maintained at the austenitizing temperature for a time period of controlled duration selected to be approximately one hour.

11. The method of claim 1 wherein the final quenching step comprises cold treating the steel to a temperature substantially below room temperature.

12. The method of claim 11 wherein the step of cold treating comprises cooling the steel to a temperature of substantially −100° F. (−38° C.) or less and for maintaining said cold treating temperature for a period of up to approximately one hour.

13. The method of claim 1 wherein the intermediate quenching step comprises rapidly quenching the austenitized steel from the austenitizing temperature to a temperature just above the martensite start temperature for the selected steel composition and thereafter further cooling the steel to an intermediate quenching temperature just below said martensite start temperature thereby forming martensite crystal grains from the intermediate quenching step larger than those from the final quenching step.

14. The method of claim 13 wherein said high carbon steel comprises 52100 steel and wherein the intermediate quenching step comprises quenching the austenitized steel from the full austenitizing temperature to approximately 325° F. (163° C.) and thereafter cooling the steel to a temperature in the range of approximately 212° F. (100° C.) to 260° F. (126° C.).

15. The method of claim 1 wherein the step of quenching the austenitized steel in an intermediate quenching step comprises rapidly quenching the steel from the austenitizing temperature to a temperature just above the martensite start temperature of the selected steel composition and thereafter slowly cooling or quenching the steel to a temperature below the martensite start temperature for the selected steel composition but substantially above the final quench temperature in a timed quenching or cooling.

16. The method of claim 1 wherein the step of heating the steel to the full austenitizing temperature of the selected steel composition comprises heating the steel to the austenitizing threshold temperature of the selected steel composition.

17. A method for hardening high carbon steel of selected steel composition comprising:

heating the steel to the full austenitizing temperature of the selected steel composition and maintaining the full austenitizing temperature for sufficient time to dissolve the high carbon content phase into the austenite structure;

quenching the austenitized steel in an intermediate quenching step to a temperature below the martensite start temperature for a selected steel composition in a temperature range immediately adjacent to the martensite start temperature and substantially above the final quench temperature;

controlling and limiting the time duration of the intermediate quenching step to initiate transformation of only a minor portion of the austenite structure to martensite in the preferred range of approximately 20% to 35% of the autenite;

tempering the martensite formed by the intermediate quenching step in an intermediate tempering step at a temperature above said intermediate quenching temperature and above the martensite start temperature in the lower end of the martensite tempering temperature range thereby halting the intermediate transformation to martensite and imparting toughness to the minor portion of martensite formed during the intermediate quenching step;

quenching the steel in a final quenching step immediately following the intermediate tempering step to a final quenching temperature substantially below the intermediate quenching temperature and substantially transforming the remaining portion of austenite to martensite so that the steel as finally quenched comprises a major portion of untempered martensite intermixed with a minor portion of tough tempered martensite thereby minimizing or avoiding microcracking which may be caused by mutual impingement of untempered martensite crystals;

and tempering the steel in a final tempering step thereby transforming the untempered martensite to a finely dispersed and substantially homogeneous mixture of carbide precipitate in ferrite substantially without microcracking.

18. The method of claim 17 wherein the intermediate quenching step comprises rapidly quenching the austenitized steel from the austenitizing temperature to a temperature just above the martensite start temperature for the selected steel composition and thereafter further cooling the steel to the intermediate quenching temperature just below the martensite start temperature in the range immediately adjacent to the martensite start temperature thereby forming martensite grains from the intermediate quenching step larger than those formed during the final quenching step.

* * * * *